US006208082B1

(12) United States Patent
Kim et al.

(10) Patent No.: US 6,208,082 B1
(45) Date of Patent: Mar. 27, 2001

(54) METHOD FOR DRIVING SURFACE DISCHARGE TYPE PLASMA DISPLAY PANEL

(75) Inventors: Sang-Chul Kim; Eun-gi Heo, both of Chonan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/464,438

(22) Filed: Dec. 16, 1999

(30) Foreign Application Priority Data

Dec. 19, 1998 (KR) ..... 98-56426
Jan. 18, 1999 (KR) ..... 99-1243

(51) Int. Cl.[7] ..... G09G 3/10

(52) U.S. Cl. ..... 315/169.1; 345/60; 345/55; 345/214

(58) Field of Search ..... 315/169.1, 169.2, 315/169.3, 169.4; 345/60, 62, 68, 204, 214

(56) References Cited

U.S. PATENT DOCUMENTS 5,963,184 * 10/1999 Tokunaga et al. ..... 345/60
5,966,107 * 10/1999 Amemiya ..... 345/60
6,084,558 * 7/2000 Setoguchi et al. ..... 345/60

* cited by examiner

*Primary Examiner*—Don Wong
*Assistant Examiner*—Tuyet T. Vo
(74) *Attorney, Agent, or Firm*—Leydig, Voit & Mayer, Ltd.

(57) ABSTRACT

A method for driving a surface discharge type plasma display panel (PDP) having a matrix display form is provided. The surface discharge type PDP is driven by a progressive driving method such that non-discharge regions are removed by combining common and scanning electrodes traversing neighboring discharge cells or two neighboring scanning electrodes into one. While the scanning electrodes traversing neighboring discharge cells are reduced to one to be used in common, sequential scanning is allowed. Thus, the number of driver circuits can be reduced. Also, since the distance between electrodes of the respective lines can be reduced, a high-precision PDP can be achieved by reducing a line pitch. Also, the ratio of the area occupied by display electrodes in a unit emission region is increased and the range in which a surface discharge occurs is extended, thereby improving the luminance.

6 Claims, 10 Drawing Sheets

METHOD FOR DRIVING SURFACE DISCHARGE TYPE PLASMA DISPLAY PANEL

BACKGROUND OF THE INVENTION

1. Field of the Invention

The present invention relates to a method for driving a surface discharge type plasma display panel (PDP) having a matrix display form.

2. Description of the Related Art

FIGS. 1A and 1B show the structures of conventional surface discharge type PDPs. FIG. 1A is a cross sectional view taken in a direction parallel to address electrodes, for illustrating the position where a discharge space is formed according to the arrangement of discharge sustaining electrodes. As shown in the drawing, the conventional surface discharge type PDP is constructed such that a front substrate 1 and a rear substrate 2 are disposed at a predetermined distance to be opposed to each other, and address electrodes 4 and discharge sustaining electrodes 3 are arranged on the opposing surfaces to intersect each other. Here, the discharge sustaining electrodes are arranged such that a common electrode (X) and a scanning electrode (Y) are paired and a black stripe 6 for shielding light is interposed therebetween. A discharge space 5 is formed between each pair of discharge sustaining electrodes, that is, between the common electrode (X) and the scanning electrode (Y). A region where the black stripe 6 is disposed is a non-discharge region 7.

FIG. 1B is a plan view showing the structure of discharge sustaining electrodes of another conventional PDP, applied to 50" PDP products manufactured by Pioneer Electronic Corporation. The discharge sustaining electrodes of another conventional PDP shown in FIG. 1B are constructed such that a pair of a scanning electrode (Y-electrode) and a common electrode (X-electrode) are arranged for each line of a discharge cell in a direction intersecting a partition 53. The scanning electrode and common electrode pair is constructed such that a T-shaped transparent electrode 52 is connected to a bus line 51. In order to reduce a non-discharge region 54 formed in a gap between two adjacent discharge cells, the electrodes are arranged in order, that is, (X, Y1) (Y2, X)(X, Y3) (Y4, X1)(X . . . . However, the non-discharge region 54 cannot be completely removed. In order to avoid an erroneous discharge, a dielectric layer (not shown) may be further formed on the non-discharge region 54 between bus lines, which makes the manufacturing process complex and wastes a light-emission region, lowering the luminance.

In the above-described conventional PDP, there is one scanning electrode for each line of a discharge cell. Thus, as many scanning drivers as vertical lines of a display format, that is, the total number of scanning electrodes, are necessary. For example, 480, 768 and 1080 scanning drivers are required for a VGA (Video Graphic Array) PDP, an XGA (Extended Graphic Array) PDP and a HD (High Definition) PDP, respectively. That is to say, a large number of driving chips are necessary for driving electrodes.

In the surface discharge type PDPs having the above-described configurations, as shown in FIG. 2, an address electrode and a common electrode are selected and then an address voltage is applied therebetween to form wall charges on a discharge cell corresponding to a particular pixel, and a sustained discharge is made to occur only at the discharge cells where wall charges have been formed when a common discharge sustaining pulse is applied to the discharge sustaining electrodes, thereby displaying a picture of each field. Thus, a picture is divided into fields divided in a time-division manner to then be displayed in a time-sequence basis. According to this driving method, since the non-discharge region where the black stripe 6 is formed occupies a considerable amount of space, the overall luminance is poor and the resolution is deteriorated.

FIG. 3 is a cross-sectional view of a PDP employing an alternative lighting surfaces (ALiS) method in which a non-discharge region is removed from the above-described conventional surface discharge PDP. As shown in FIG. 3, in the ALiS-driven PDP, a front substrate 100 and a rear substrate 200 are disposed opposite to each other, and address electrodes 400 and discharge sustaining electrodes 300 are arranged on opposite surfaces to intersect each other, which is the same as the above-described PDP. However, a black matrix for shielding light is not arranged between the pairs of discharge sustaining electrodes 300 so that the discharge sustaining electrodes 300 are arranged in a stripe pattern at a constant interval. In other words, each common electrode (X) or scanning electrode (Y) is shared by two adjacent discharge cells. Thus, since the electrode arrangement density for a given area can be increased, the resolution of a picture can be enhanced. Also, since the non-discharge region is removed, the luminance is increased.

FIG. 4 illustrates a method for driving the surface discharge PDP employing an ALiS method. As shown in the drawing, according to the ALiS method developed by Fujitsu Limited, there is no non-discharge region and discharge spaces (500 of FIG. 3) are secured at all discharge sustaining electrodes (300 of FIG. 3) to cause a discharge, which is used in displaying a screen. In particular, this driving method is suitable for an analog broadcasting method such as Hi-vision broadcasting and is realized by interlaced scanning, as shown in FIG. 4. In other words, in driving discharge sustaining electrode pairs for displaying a picture of one frame, for odd-numbered discharge lines, a discharge is caused in the first field to form a pixel, and for even-numbered discharge lines, a discharge is caused in the second field to form a pixel. Here, the term "discharge line" refers to a set of discharge cells driven by arbitrary neighboring pairs of X and Y electrodes. Thus, in applying this driving method to a digital television broadcasting system, the method is applicable only to high-definition (HD) systems of 1080I (Here, the character I denotes interlaced scanning.) but is not applicable to 720P or 1080P systems (Here, the character P denotes progressive scanning.).

SUMMARY OF THE INVENTION

To solve the above problems, it is an objective of the present invention to provide a method for driving a surface discharge type plasma display panel (PDP), by which the surface discharge type PDP which is simplified by removing a non-discharge region can be driven by a progressive scanning method rather than an interlaced scanning method.

Accordingly, to achieve the above objective, there is provided a method for driving an alternating-current (AC) type surface discharge plasma display panel (PDP) having two substrate to be opposed to each other, address electrodes arranged on the opposing surface of one of two substrates in a stripe pattern, and discharge sustaining electrodes on the opposing surface of the other substrate in a stripe pattern to intersect the data electrodes, wherein assuming that common electrodes of odd-numbered lines are denoted by Xa, common electrodes of even 5 numbered lines are denoted by Xb, and an nth scanning electrode is denoted by Yn, where n=1, 2, 3, . . . , the common electrodes and the scanning electrodes are arranged in the order Xa-Y1-Xb-Y2-Xa-Y3-Xb-Y4- . . . so that discharge cells of 2n lines are formed by (2n+1) discharge sustaining electrodes, the method including the steps of: in an addressing period in which an address pulse is applied to the addressing electrodes, sequentially applying to the Y electrodes a pulse for addressing, having the opposite polarity to that of the address pulse, in a period corresponding to the address pulse of the addressing electrodes, and a pulse for an auxiliary discharge, having the opposite polarity to that of the pulse for addressing, in a preceding period of the period corresponding to the address pulse of the addressing electrodes, the pulse for an auxiliary discharge and the pulse for addressing being applied twice for each Y electrode; and independently coupling Xa electrodes and Xb electrodes in pairs, and applying to the paired Xa and Xb electrodes pulses for preventing an auxiliary discharge having the same polarity in the same period as that of the pulse for an auxiliary discharge, the pulses for preventing an auxiliary discharge, corresponding to two pulses for an auxiliary discharge, which are applied to the same Y electrodes, being independently applied to the Xa electrodes and the Xb electrodes, respectively, and the pulses for preventing an auxiliary discharge, corresponding to the pulse for an auxiliary discharge applied second to the Y electrode which is driven previously among two neighboring Y electrodes and corresponding to the pulse for an auxiliary discharge applied first to the Y electrode which is driven later, being applied to the same X electrodes among the Xa electrodes and the Xb electrodes.

In the present invention, a striped partition or a matrix partition for defining discharge cells may be provided. The discharge sustaining electrodes are preferably constructed such that an I- or T-shaped transparent conductive layer is basically disposed and striped bus electrodes are arranged thereon. Alternatively, the discharge sustaining electrodes may be constructed such that striped bus electrodes are basically arranged and an I- or T-shaped transparent conductive layer is disposed thereon.

According to another aspect of the present invention, there is provided a method for driving an alternating-current (AC) type surface discharge plasma display panel (PDP) having three electrodes provided for discharge cells of every two lines, to form discharge sustaining electrodes arranged such that two common electrodes (Xa) are disposed in either side and a scanning electrode (Yn where n 1, 2, 3, . . . ) is disposed in the center, wherein assuming that common electrodes of odd-numbered lines are denoted by Xa and the common electrodes of even10 numbered lines are denoted by Xb, the overall common and scanning electrodes of the PDP are arranged in the order Xa-Y1-Xb-Xa-Y2-Xb-Xa-Y3-Xb-Xa-Y4- . . . Xa-Yn-Xb to drive the discharge sustaining electrodes, the method including the steps of: in an addressing period in which a pulse for addressing is applied to addressing electrodes of the PDP, applying to the Y electrodes a pulse for addressing in a period corresponding to the address pulse of the addressing electrodes, and a pulse for an auxiliary discharge, having a polarity opposite to that of the pulse for addressing, in a preceding period of the period corresponding to the address pulse of the addressing electrodes, the pulse for an auxiliary discharge and the pulse for addressing being sequentially applied twice for each electrode; and independently coupling Xa electrodes and Xb electrodes in pairs, and applying thereto pulses for preventing an auxiliary discharge having the same polarity in different periods, the pulses for preventing an auxiliary discharge being applied to the Xa electrodes in the period corresponding to the second pulse for an auxiliary discharge and pulses for preventing an auxiliary discharge being applied to the Xb electrode in the period corresponding to the first pulse for an auxiliary discharge.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

A PDP driving method according to the present invention will now be described in detail with reference to the accompanying drawings.

Figure 5:
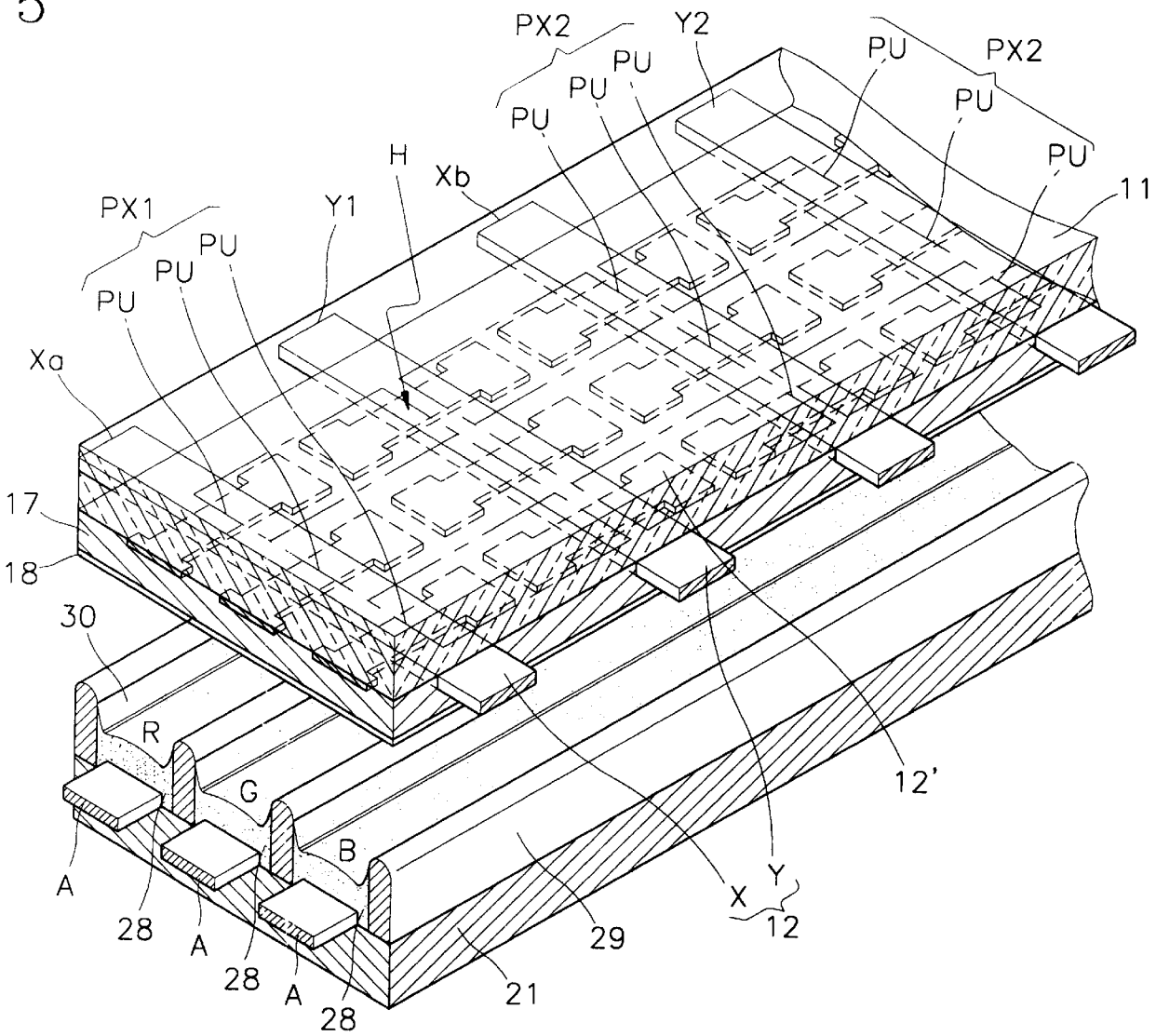
FIG. 5 is an exploded perspective view illustrating a schematic structure of a surface discharge type PDP according to the present invention.

FIG. 5 is an exploded perspective view illustrating the schematic structure of a surface discharge type PDP according to the present invention, which is simplified by reducing a non-discharge region. Referring to FIG. 5, two pixels PX1 and PX2 correspond to three electrodes Xa, Y1 and Xb, and X-electrodes and Y-electrodes are alternately arranged in succession, so that pixels are formed without a non-discharge region. In other words the electrodes are arranged in the order of Xa-Y1-Xb-Y2-Xa-Y3-Xb-Y4-Xa-Y5-Xb-.

The PDP shown in FIG. 5 is a three-electrode surface discharge type PDP in which a set of display electrodes X and Y and address electrodes A correspond to a unit emission region PU for a matrix display, and is also referred to as a reflection type PDP in view of the arrangement of phosphors. In the drawing, a first pixel PX1 consisting of three unit emission regions PUs is formed between the display electrodes Xa and Y1, a second pixel PX2 consisting of three unit emission regions PUs is formed between the display electrodes Y1 and Xb, and a third pixel PX3 consisting of three unit emission regions PUs is formed between the display electrodes Xb and Y2.

The display electrodes X and Y for a surface display are disposed on a front glass substrate 11 of a displayed surface H and are covered by a dielectric layer 17 to be insulated from a discharge space 30. In other words, the display electrodes X and Y form a discharge sustaining pair 12 for AC driving. Also, an MgO layer 18 having a thickness of several thousand angstroms (A) is installed on the dielectric layer 17 as a protective layer of the display electrodes X and Y.

Furthermore, since the display electrodes X and Y are disposed on the displayed surface H with respect to the discharge space 30, the surface discharge may expand. Also, in order to minimize the shielding of displayed light, an I-shaped (T-shaped or striped) transparent conductive layer 12' made of a transparent electrode material such as indium tin oxide (ITO) is connected to a metal layer (bus electrode) 12 having excellent conductivity. In other words, bus electrodes are arranged to traverse the central portion of the transparent conductive layer 12'. Here, display electrodes consist of bus electrodes and a transparent conductive layer.

The address electrodes A for selectively making unit emission regions PU luminous are arranged on a rear glass substrate 21 at a constant pitch to be orthogonal to the display electrodes X and Y.

A 80 to 160 $\mu$m high partition 29 having a stripe pattern is disposed between neighboring address electrodes A, to define the discharge space 30 at every unit emission region PU along the line direction, that is, the direction along which the display electrodes X and Y extend.

Phosphors 28 for three primary colors of red (R), green (G) and blue (B) are formed on the rear glass substrate 21 to cover the inner surface of the rear glass substrate 21 including the top surfaces of the address electrodes A and the lateral surfaces of the partition 29. The phosphors 28 for the respective colors are excited by ultraviolet rays generated by discharge gas in the discharge space, thereby emitting light. As described above, the PDP allows a full-color display by combining the primary R, G and B. Alternatively, the address electrodes A may be covered by a dielectric layer.

Figure 1A:
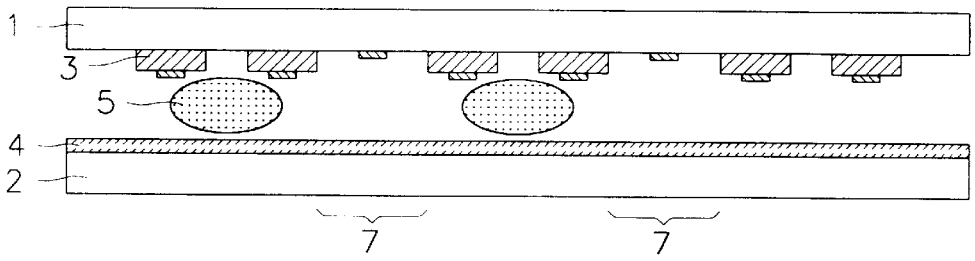
FIG.1A (PRIOR ART)
FIG. 1A is a cross-sectional view illustrating a conventional surface discharge type plasma display panel (PDP)
Figure 2:
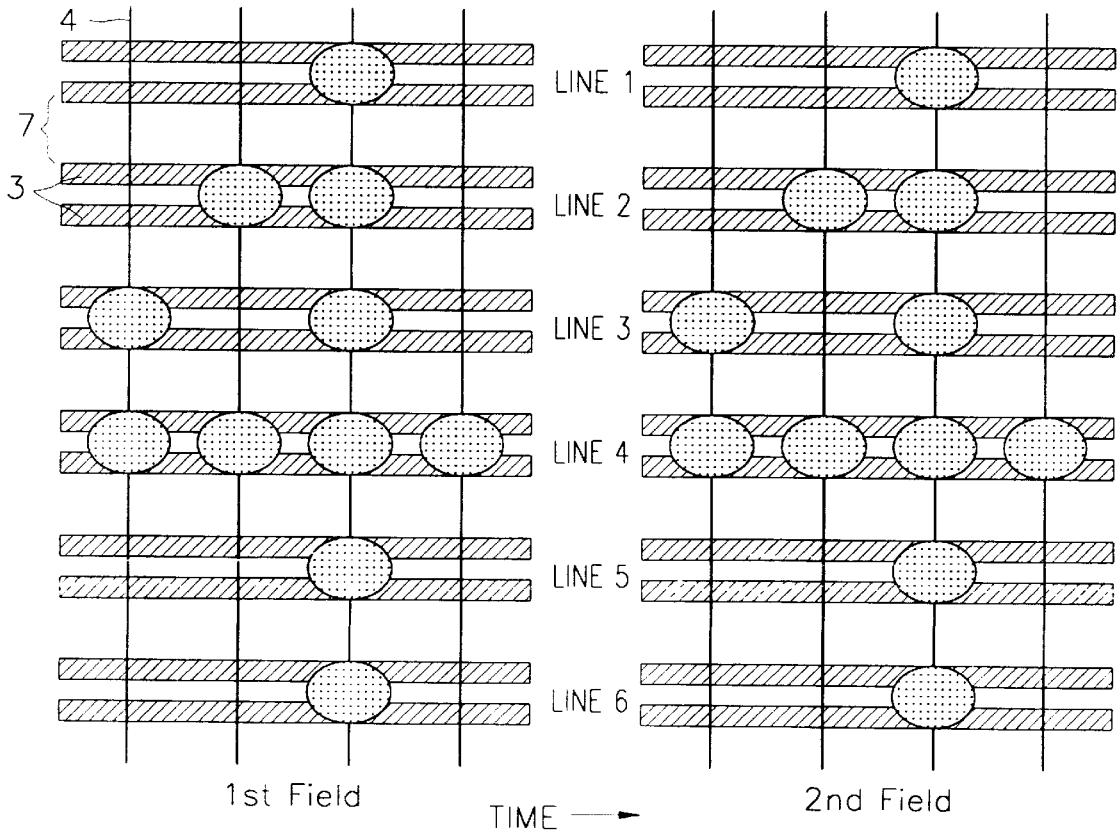
FIG. 2 (PRIOR ART)
FIG. 2 is a diagram for explaining a method for driving the surface discharge type PDP shown in FIG. 1A or 1B.
Figure 1:
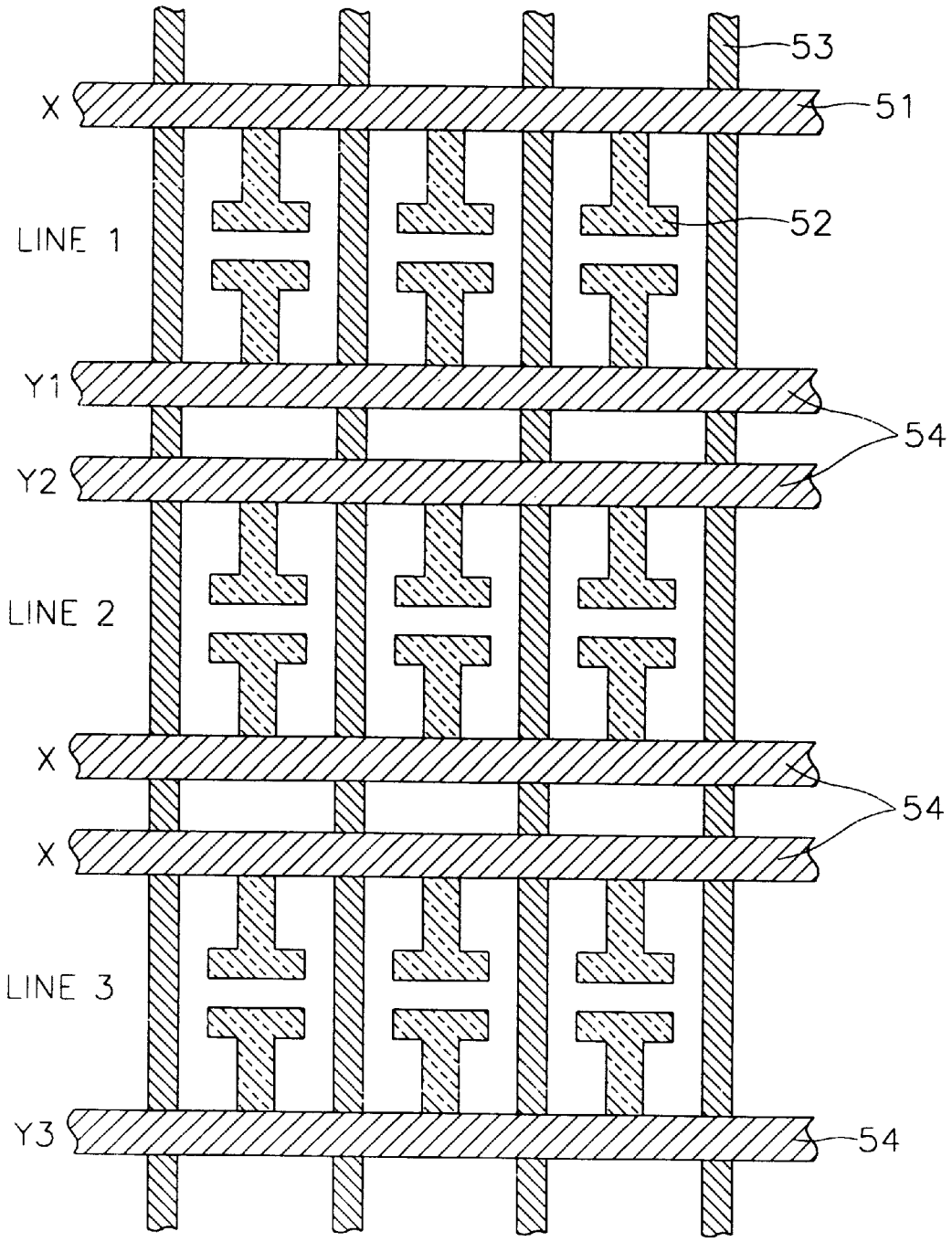
FIG. 1 B (PRIOR ART)
FIG. 1B is a plan view illustrating the structure of discharge sustaining electrodes in another conventional surface discharge type PDP.
Figure 3:
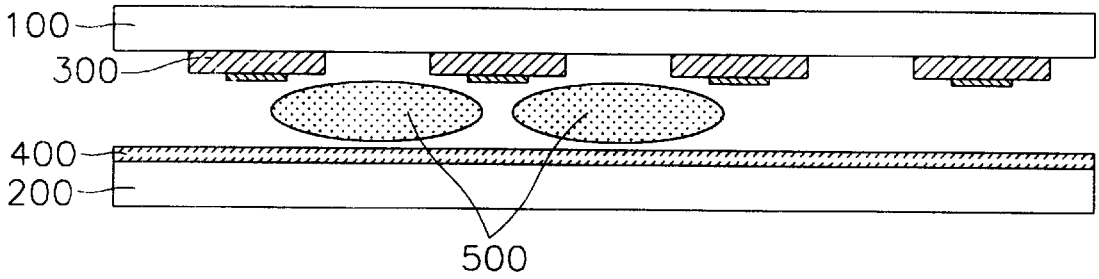
FIG. 3 (PRIOR ART)
FIG. 3 is a cross-sectional view illustrating another conventional surface discharge type PDP employing an ALiS method.
Figure 4:
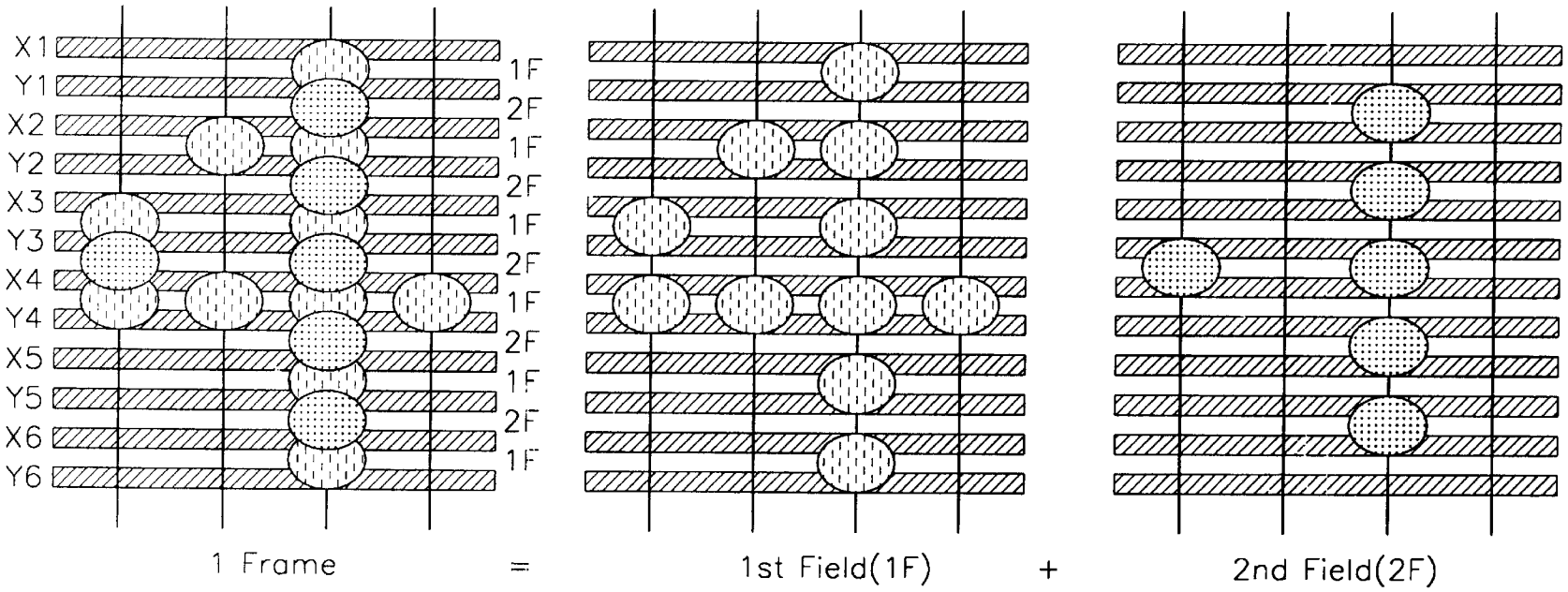
FIG. 4 (PRIOR ART)
FIG. 4 is a diagram for explaining a method for driving the surface discharge type PDP shown in FIG. 3.
Figure 6:
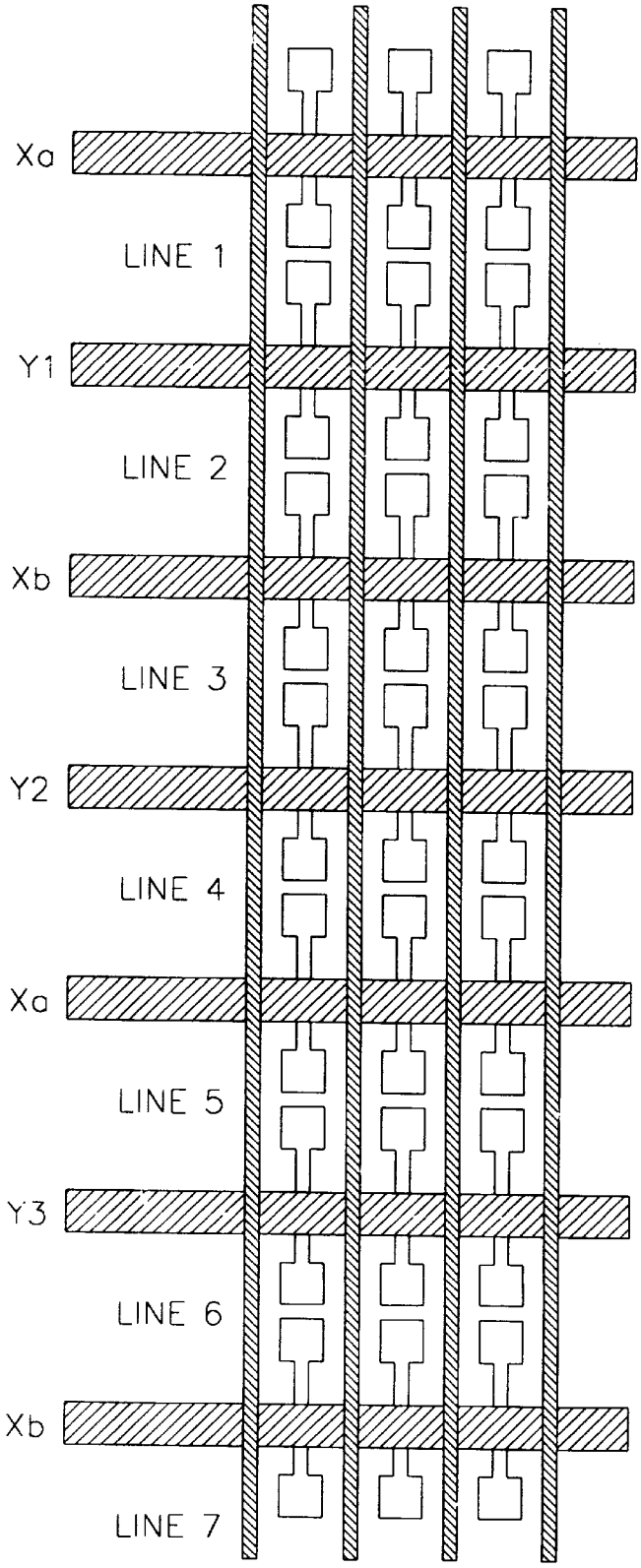
FIG. 6 is a plan view illustrating the structure of discharge sustaining electrodes in the surface discharge type PDP shown in FIG. 5.

FIG. 6 is a schematic plan view showing a modification of the electrodes in the PDP shown in FIG. 5. In the PDP shown herein, among the display electrodes arranged in the form of (Xa, Y1) (Y2, Xb) (Xa, Y3), (Y4, Xb) (Xa . . . in each line for a matrix display in the PDP shown in FIG. 1, two X-electrodes of neighboring lines, for example, Xb and Xa, and two Y-electrodes, for example, Y1 and Y2 or Y3 and Y4, are combined into each one of the X and Y electrodes, thereby constituting display electrodes. In other words, non-discharge regions between X and X and between Y and Y are removed from the conventional electrode structure of XYYXXYYXX . . . shown in FIG. 1A or 1B, thereby expanding the area of discharge regions to enhance the luminance. By constructing the display electrodes in such a manner, as described above, two pixels, e.g., PX1 and PX2, correspond to three sequential electrodes, e.g., Xa, Y1 and Xb, and another two pixels, e.g., PX2 and PX3 correspond to the next succeeding three electrodes, e.g., Y1, Xb and Y2. In other words, the display electrodes are arranged in the order of Xa-Y1-Xb-Y2-Xa-Y3-Xb-Y4- so that discharge cells are successively formed in the order of Xa-Y1, Y1-Xb, Xb-Y2 . . . , thereby arranging (n+1) display electrodes at discharge cells of n lines. In addition, since the number of X and Y electrodes is reduced to nearly half that of the conventional case, the number of drivers necessary is reduced, thereby saving the manufacturing cost of a driving circuit. Also, the PDP is driven by a progressive scanning method, thereby realizing a high quality picture for the same level of resolution.

In the above-described arrangement of electrodes, two display electrodes X and Y having the same widths are alternately arranged at equal distances. Eventually, (n+1) display electrodes (X and Y-electrodes) extend at the discharge cells of n lines at constant distances parallel to each other. The X-electrodes are display electrodes having a first polarity and the Y-electrodes are display electrodes having a second polarity opposite to the first polarity in the application of driving voltages for a surface discharge.

Figure 7:
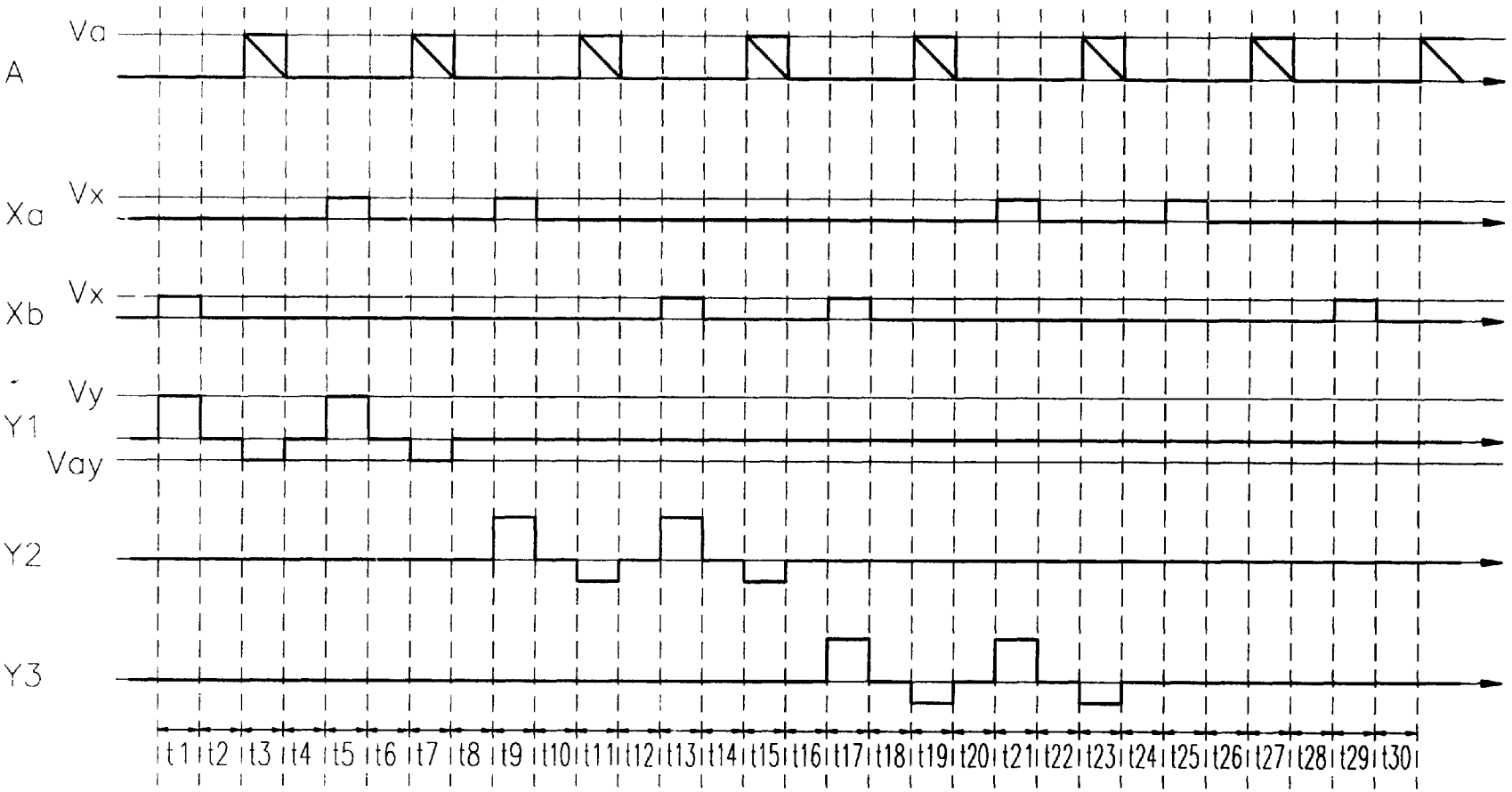
FIG. 7 illustrates waveforms of driving signals of various electrodes for driving the surface discharge type PDP shown in FIG. 5.

The respective display electrodes X and Y are arranged in the order of Xa-Y1-Xb-Y2-Xa-Y3-Xb-Y4- and the discharge cells are successively formed in the order of Xa-Y1, Y1-Xb, Xb-Y2 . . . so as to alternately apply driving pulses to the corresponding display electrodes X and Y in the same cell. To this end, in the PDP driving method according to the present invention, for a driving method during an address period, erasure-type addressing is employed after an auxiliary scanning discharge, as shown in FIG. 7.

First, in a period t1, an auxiliary scanning discharge occurs between the electrodes Xa and Y1 (in which a discharge cell of a line 1 is selected). Here, in order to prevent a discharge from occurring in a discharge space between the electrodes Xb and Y1 (a discharge cell of a line 2), a pulse voltage Vx having the same polarity as a pulse voltage Vy applied to the electrode Y1 is applied to the electrode Xb. By doing so, a voltage of Vy-Vx is applied to the discharge space between the display electrodes Xb and Y1, that is, the discharge cell of a line 2. Thus, Vx and Vy must be set to values so as not to cause a discharge at the voltage of Vy-Vx.

Next, in a period t3, if a pulse voltage Va is applied to the address electrode A, an addressing discharge occurs only at a discharge cell selected among discharge cells of a line 1, where a preceding auxiliary discharge has occurred. In other words, even though the addressing voltage Va is applied between the address electrode A and the display electrode Y1, and thus the same voltage is applied to the discharge cells of the lines 1 and 2, an addressing discharge occurs only at a selected discharge cell of the line 1 because the space charges and wall charges produced by the preceding auxiliary scanning discharge are present only at the discharge cell of the line 1. Here, a pulse voltage Vay having an opposite polarity to the addressing voltage Va is applied to the electrode Y1 and at the same time the addressing voltage Va is appropriately decreased, which prevents an induction voltage having a derivative waveform from being induced to neighboring electrodes due to an excessive increase in the addressing voltage Va.

In a period t5, an auxiliary scanning discharge occurs between the electrodes Xb and Y1. Here, unlike in the period t1, a pulse voltage Vx for preventing an auxiliary discharge is applied to the display electrode Xa. The applied pulse voltage Vx for preventing an auxiliary discharge prevents a discharge from occurring in a discharge space between the electrodes Xa and Y1 (that is, the discharge cell of the line 1), and a pulse voltage Vx having the same polarity as a pulse voltage Vy applied to the electrode Y1 is applied to the electrode Xa. Here, it is notable that the pulse voltage Vx applied for preventing a discharge from occurring in a discharge space between the electrodes Xa and Y1 to the electrode Xa may cause a further discharge by synergy due to the effect of the discharge occurring in the period t3. However, the wall charges accumulating on the electrode Y1 of the line 1 have a positive polarity, which is the same as that of the pulse voltage Vx, by the discharge of the period t3, resulting in an offset. Due to the space charges produced by the discharge occurring in the period t3, a discharge cannot be caused by only the voltage Vx. Thus, the possibility of a synergistic effect by the preceding discharge is negligible, which is also applicable to the case where the polarities of driving pulse voltages are all reversed.

In a period t7, if a pulse voltage Va is applied to the address electrode A, an addressing discharge occurs only at a discharge cell selected among discharge cells of the line 2, where a preceding auxiliary discharge has occurred, which is based on the same principle as in the period t3 in which an addressing discharge selectively occurs at a discharge cell selected among discharge cells of the line 1.

In a period t9, an auxiliary scanning discharge occurs between the electrodes Xb and Y2. Here, the pulse voltage Vx applied to the electrode Xa is for preventing a discharge from occurring in a discharge space between the electrodes Xa and Y2 (that is, a discharge cell of a line 4), and a pulse voltage having the same polarity as a pulse voltage Vy applied to the electrode Y2 is applied to the electrode Xa.

Next, in a period t11, if the pulse voltage Va is applied to the address electrode A, an addressing discharge occurs only at a discharge cell selected among discharge cells of a line 3, where a preceding auxiliary discharge has occurred. In other words, since the addressing voltage Va is applied between the address electrode A and the display electrode Y2, the external voltage is applied to the discharge cells of the lines 3 and 4. However, the space charges and wall charges produced by the preceding auxiliary scanning discharge are present only at the discharge cell of the line 3. Thus, if an appropriate voltage is applied between the address electrode A and the display electrode Y2, a discharge selectively occurs at the discharge cell of the line 3.

In a period t13, an auxiliary scanning discharge occurs between the electrodes Y2 and Xa, that is, at a discharge cell of the line 4. Here, unlike in the period t9, the pulse voltage Vx for preventing an auxiliary discharge is applied to the electrode Xb. The applied pulse voltage Vx for preventing an auxiliary discharge prevents a discharge from occurring in a discharge space between the electrodes Xb and Y2 (that is, the discharge cell of the line 3), and a pulse voltage having the same polarity as a pulse voltage applied to the electrode Y2 is applied to the electrode Xb.

In a period t15, if the pulse voltage Va is applied to the address electrode A, an addressing discharge occurs only at a discharge cell selected among discharge cells of the line 4, where a preceding auxiliary discharge has occurred, which is based on the same principle as in the period t9 in which an addressing discharge selectively occurs at a discharge cell selected among discharge cells of the line 3.

As shown in FIG. 6, in a PDP having (n+1) electrodes arranged to drive discharge cells of n lines, the display electrodes Xa and Xb are electrically connected in common at the front end of each line to then be collectively connected to a separate driving voltage source for practical use. By contrast, in order to enable line-sequential scanning, the display electrodes Y are independent line by line, and the rear end of each line is connected to an individual driving voltage source corresponding to the line. Here, as shown in FIG. 7, the pulse voltage for an auxiliary discharge and the pulse voltage Vay for addressing are applied to display electrodes Y two times each, so that, of the two pulse voltages, one pulse voltage for an auxiliary discharge corresponds to the respective pulses applied to the display electrodes Xa and Xb.

In each line, surface discharge cells are defined by the display electrodes Xa, Xb and Y for each unit emission region PU partitioned by the partitions 29 (see FIG. 5). Thus, selection (addressing) of a turned-on or turned-off state of each discharge cell is done by the display electrodes Y and the address electrodes A.

After addressing, a discharge sustaining process is performed for display a picture in the PDP. For the discharge sustaining process, wall charges are selectively accumulated by line-sequential scanning during the address period and then discharge sustaining pulses are alternately applied to the display electrodes Xa and Xb and the display electrode Y of all lines during the sustained discharge period.

Here, with respect to discharge cells of two neighboring lines, the X-electrode and Y-electrode adjacent to each other are alternately arranged to remove a non-discharge region, thereby narrowing the distance between electrodes, which implies that the widths of the display electrodes X and Y can be increased. If the widths of the display electrodes X and Y are increased, the areas of the display electrodes X and Y occupied in the unit emission region PU increase, thereby expanding the surface discharge and improving the luminance.

Furthermore, with respect to an odd-numbered X-electrode Xa, an even-numbered Y-electrode Yb and a Y-electrode, if a driving voltage is applied by connecting a driving voltage source to the same-side ends in the direction in which these electrodes extend, the directions in which discharge current flow are the same as each other. Thus, despite a drop in the voltage due to resistance at each display electrodes X and Y, the potentials at various portions in the extending direction become substantially the same as each other at each line. In other words, even though there is a relatively large potential difference between the ends and central portion of the display electrodes X and Y, like in the case of a large screen in which the display electrodes X and Y are long, the potentials are substantially evenly distributed along a line direction in the display electrodes X (or Y) having the same polarity and there is no difference in the potential in a columnar direction.

Although a reflection-type PDP has been described in the illustrative embodiment, the present invention can also be applied to a transmission-type PDP in which phosphors 28 are disposed on the inner surface of the glass substrate 11 of a displayed surface (H) side. Also, the address electrodes A may be arranged on the glass substrate 12 where the display electrodes X and Y are arranged.

Figure 8:
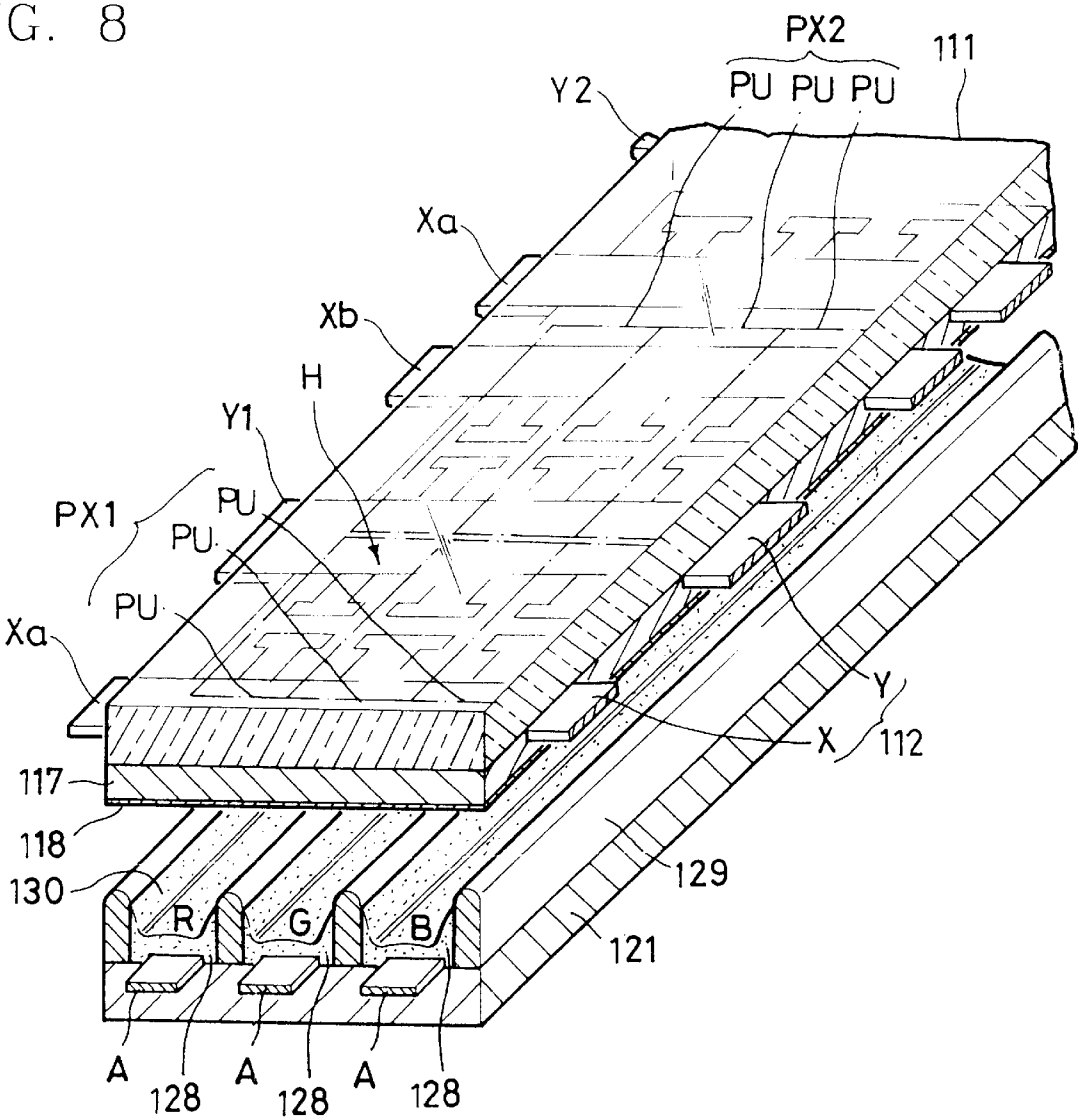
FIG. 8 is an exploded perspective view schematically illustrating a surface discharge type PDP described in a patent application invented by the applicant of the present invention, which has been filed but not yet published in Korea, in which a front substrate and a rear substrate are separated from each other.

FIG. 8 is an exploded perspective view schematically illustrating a surface discharge type PDP described in a Korean Patent Application No. 99-1243, which was filed by the applicant of the present invention but not yet published in Korea, in which a front substrate and a rear substrate are separated from each other, which is different from that shown in FIG. 5 in that two pixels, e.g., PX1 and PX2, correspond to three electrodes, e.g., Xa, Y1 and Xb. That is, the display electrodes are arranged in the order of Xa-Y1-Xb-Xa-Y2-Xb-Xa-Y3-Xb-Xa-Y4-.

The PDP shown in FIG. 8 is a three-electrode surface discharge type PDP in which a set of display electrodes X and Y and address electrodes A correspond to a unit emission region PU for a matrix display, and is also referred to as a reflection type PDP in view of the arrangement of phosphors.

The display electrodes X and Y for a surface display are disposed on a front glass substrate 111 of a displayed surface H and are covered by a dielectric layer 117 to be insulated from a discharge space 130. In other words, the display electrodes X and Y form a discharge sustaining pair 112 for AC driving. Also, an MgO layer 118 having a thickness of several thousand angstroms (A) is installed on the dielectric layer 117 as a protective layer of the dielectric layer 117.

Furthermore, since the display electrodes X and Y are disposed on the displayed surface H with respect to the discharge space 130, the surface discharge may expand. Also, in order to minimize the shielding of displayed light, a T-shaped transparent conductive layer 112' made of a transparent electrode material such as indium tin oxide (ITO) is connected to a metal layer (bus electrode) 112 having excellent conductivity.

The address electrodes A for selectively making unit emission regions PUs luminous are arranged on a rear glass substrate 121 at a constant pitch to be orthogonal to the display electrodes X and Y.

A 200 $\mu$m high partition 129 having a stripe pattern is disposed between neighboring address electrodes A, to define the discharge space 130 at every unit emission region PU along the line direction, that is, the direction along which the display electrodes X and Y extend.

Phosphors 128 for three primary colors of red (R), green (G) and blue (B) are formed on the rear glass substrate 121 to cover the inner surface of the rear glass substrate 121 including the top surfaces of the address electrodes A and the lateral surfaces of the partition 129. The phosphors 128 for the respective colors are excited by ultraviolet rays generated by discharge gas in the discharge space, thereby emitting light. As described above, the PDP allows a full-color display by combining the primary R, G and B. Alternatively, the address electrodes A may be covered by a dielectric layer.

Figure 9:
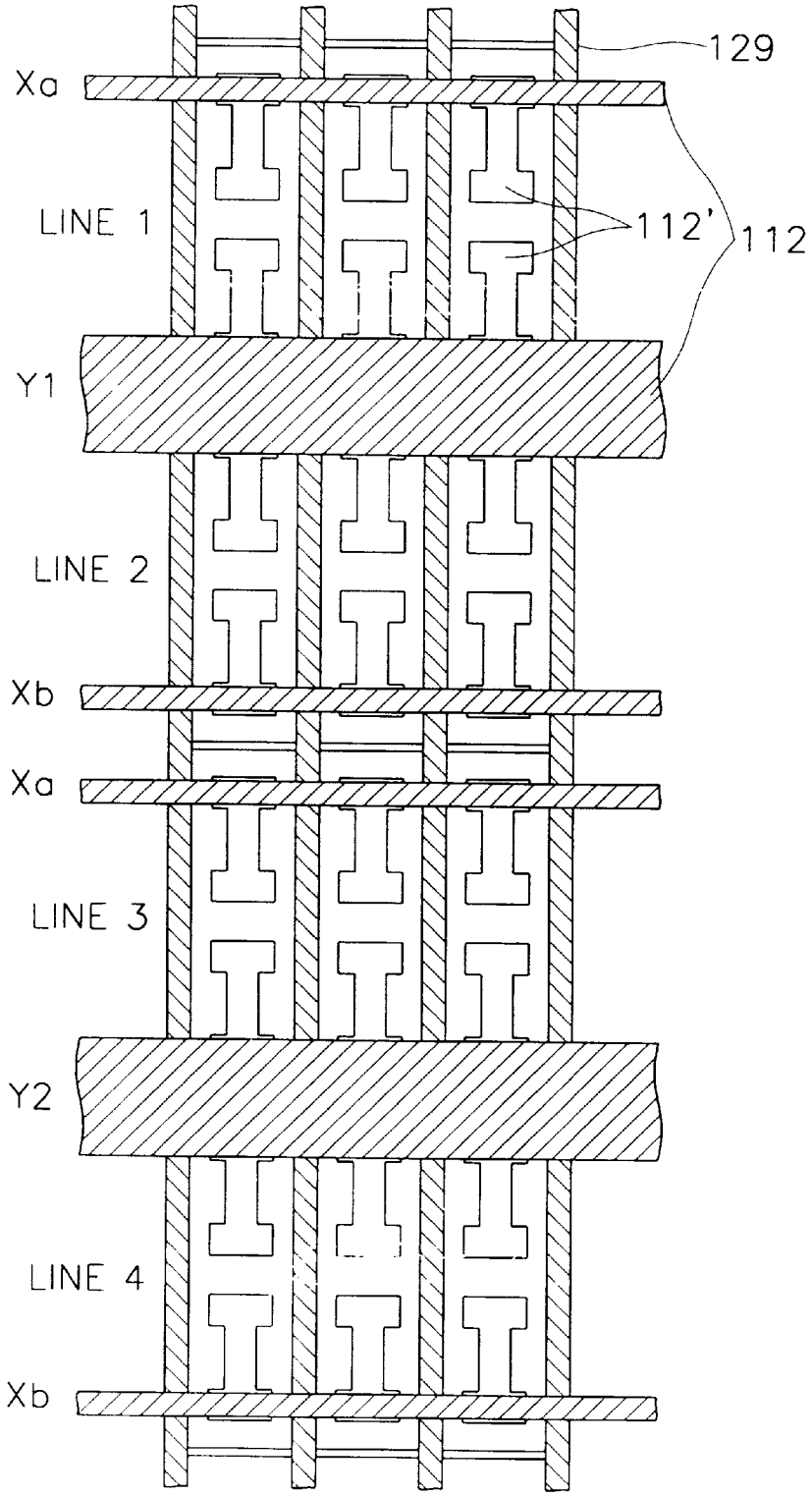
FIG. 9 is a plan view illustrating the structure of discharge sustaining electrodes in the surface discharge type PDP shown in FIG. 8.

FIG. 9 is a schematic plan view showing a modification of the electrodes in the PDP shown in FIG. 8. In the PDP shown in FIG. 9, among the display electrodes arranged in the form of (Xa, Y1) (Y2, Xb) (Xa, Y3), (Y4, Xb) (Xa . . . in each line for a matrix display in the PDP shown in FIG. 1, two Y-electrodes of neighboring lines, for example, Y1 and Y2, or Y3 and Y4, are combined into one of the Y electrodes, thereby constituting display electrodes. In other words, non-discharge regions between Y and Y are removed from the conventional electrode structure of XYYXX-YYXX . . . shown in FIG. 1A or 1B, thereby reducing the non-discharge region and expanding the area of discharge regions to enhance the luminance. By constructing the display electrodes in such a manner, as described above, two pixels, e.g., PX1 and PX2, correspond to three electrodes, e.g., Xa, Y1 and Xb. In other words, the display electrodes are arranged in the order of Xa-Y1-Xb-Xa-Y2-Xb-Xa-Y3-Xb-Xa-Y4- so that discharge cells are successively formed in the order of Xa-Y1, Y1-Xb, Xa-Y2 . . . . In addition, since the number of Y electrodes, that is, scanning electrodes, is reduced to nearly half that of the conventional case, the number of drivers necessary is reduced to 239, 383 and 539 for a VGA PDP, an XGA PDP and a HD PDP, respectively, thereby reducing the manufacturing cost of a driving circuit. Also, the PDP is driven by a progressive scanning method, thereby realizing high quality of a picture for the same level of resolution.

In the above-described arrangement of electrodes, three display electrodes extend along discharge cells of two lines at constant intervals. Also, two display electrodes Xa and Xb having the same width, are alternately arranged at equal intervals, with a display electrode Y having a different width from that of the display electrode Xa or Xb disposed therebetween (see FIG. 9). Here, the display electrode Y is made to have a larger width in the arrangement direction than the display electrode X (Xa or Xb) and is arranged at the center in discharge cells of two neighboring lines, that is, in the center of the display electrodes Xa and Xb, to then be shared. Eventually, the number of display electrodes X is the same as that of discharge lines and the number of display electrodes Y is half that of discharge lines. The X-electrodes are display electrodes having a first polarity and the Y-electrodes are display electrodes having a second polarity in the application of driving voltages for a surface discharge.

Figure 10:
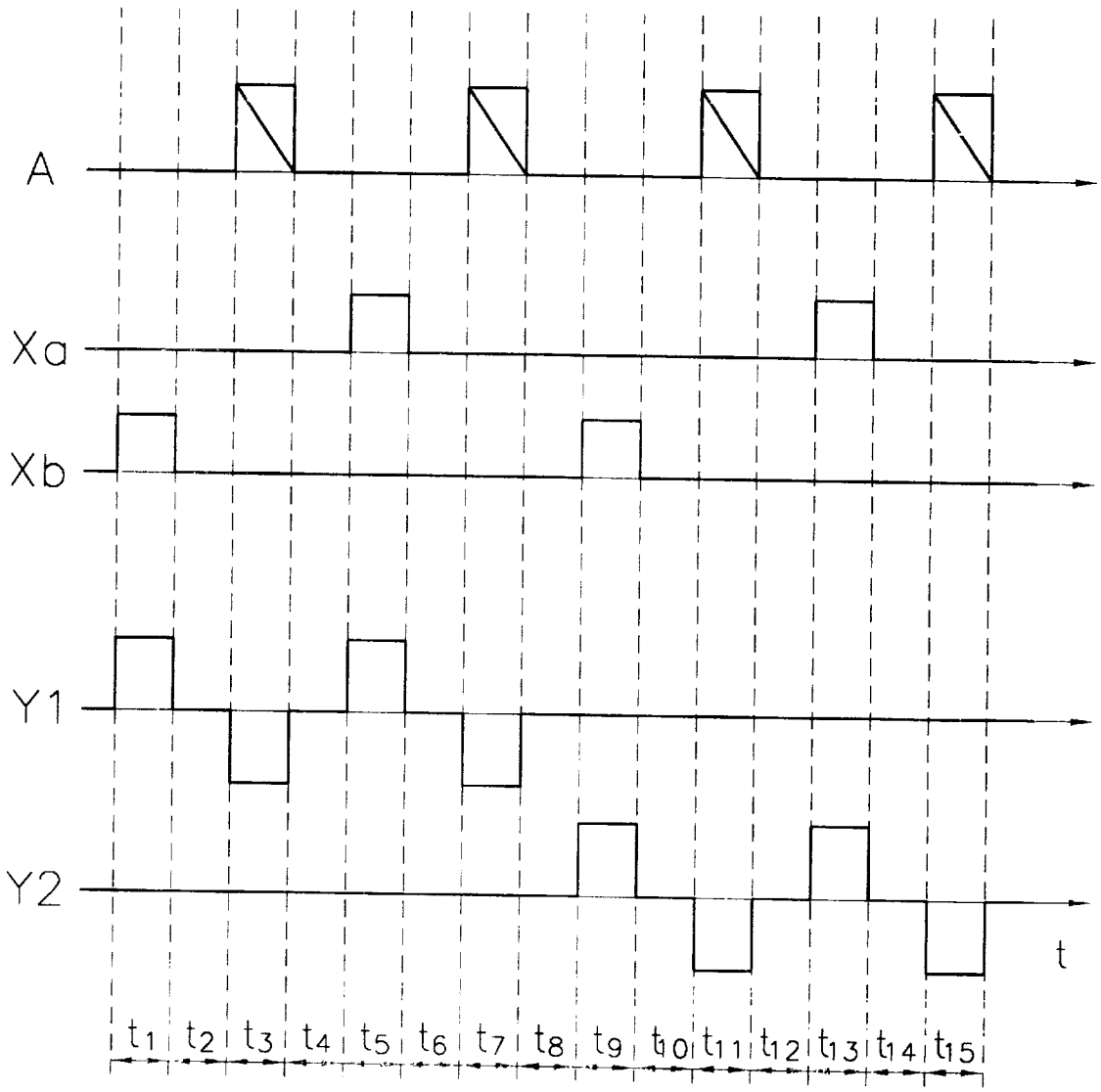
FIG. 10 illustrates waveforms of driving signals of various electrodes for driving the surface discharge type PDP shown in FIG. 9.

The respective display electrodes X and Y are arranged in the order of Xa-Y1-Xb-Xa-Y2-Xb-Xa-Y3-Xb-Xa-Y4- and the discharge cells are successively formed in the order of Xa-Y1, Y1-Xb, Xa-Y2 . . . , so as to alternately apply driving pulses to the corresponding display electrodes X and Y in the same cell. To this end, in the PDP driving method according to the present invention, for a driving method during an address period, erasure-type scanning is employed after an auxiliary scanning discharge, as shown in FIG. 10.

First, in a period t1, an auxiliary scanning discharge occurs between the electrodes Xa and Y1 (in which a discharge cell of a line 1 is selected). Here, a pulse applied to the electrode Xb is for preventing a discharge from occurring in a discharge space between the electrodes Xb and Y1 (a discharge cell of a line 2), and a pulse voltage having the same polarity as a pulse voltage applied to the electrode Y1 is applied to the electrode Xb.

Next, in a period t3, if a pulse voltage is applied to the address electrode A, an addressing discharge occurs only at a discharge cell selected among discharge cells of the line 1, where a preceding auxiliary discharge has occurred. In other words, even though the addressing voltage Va is applied between the address electrode A and the display electrode Y1, and thus the same external voltage is applied to the discharge cells of the lines 1 and 2, an addressing discharge occurs only at a selected discharge cell of the line 1 because the space charges and wall charges produced by the preceding auxiliary scanning discharge are present only at the discharge cell of the line 1. Thus, if an appropriate voltage is applied to the address electrode A, a discharge selectively occurs at the discharge cell of the line 1.

In a period t5, an auxiliary scanning discharge occurs between the electrodes Xb and Y1. Here, unlike in the period t1, a pulse voltage for preventing an auxiliary discharge is applied to the electrode Xa. The applied pulse voltage for preventing an auxiliary discharge prevents a discharge from occurring in a discharge space between the electrodes Xa and Y1 (that is, the discharge cell of the line 1), and a pulse voltage having the same polarity as a pulse voltage applied to the electrode Y1 is applied to the electrode Xa.

In a period t7, if a pulse voltage is applied to the address electrode A, an addressing discharge occurs only at a discharge cell selected among discharge cells of the line 2, where a preceding auxiliary discharge has occurred, which is based on the same principle as in the period t3 in which an addressing discharge selectively occurs at a discharge cell selected among discharge cells of the line 1.

In a period t9, an auxiliary scanning discharge occurs between the electrodes Xa and Y2. Here, the pulse voltage applied to the electrode Xb is for preventing a discharge from occurring in a discharge space between the electrodes Xb and Y2 (that is, a discharge cell of a line 4), and a pulse voltage having the same polarity as a pulse voltage applied to the electrode Y2 is applied to the electrode Xa.

Next, in a period t11, if the pulse voltage is applied to the address electrode A, an addressing discharge occurs only at a discharge cell selected among discharge cells of a line 3, where a preceding auxiliary discharge has occurred. In other words, since the addressing voltage is applied between the address electrode A and the display electrode Y2, the same external voltage is applied to the discharge cells of the lines 3 and 4. However, the space charges and wall charges produced by the preceding auxiliary scanning discharge are present only at the discharge cell of the line 3. Thus, if an appropriate voltage is applied between the address electrode A and the display electrode Y2, a discharge selectively occurs at the discharge cell of the line 3.

In a period t13, an auxiliary scanning discharge occurs between the electrodes Xb and Y2, that is, at a discharge cell of the line 4. Here, unlike in the period t9, the pulse voltage for preventing an auxiliary discharge is applied to the electrode Xa. The applied pulse voltage for preventing an auxiliary discharge prevents a discharge from occurring in a discharge space between the electrodes Xa and Y2 (that is, the discharge cell of the line 3), and a pulse voltage having the same polarity as a pulse voltage applied to the electrode Y2 is applied to the electrode Xa.

In a period t15, if the pulse voltage Va is applied to the address electrode A, an addressing discharge occurs only at a discharge cell selected among discharge cells of the line 4, where a preceding auxiliary discharge has occurred, which is based on the same principle as in the period t9 in which an addressing discharge selectively occurs at a discharge cell selected among discharge cells of the line 3.

As shown in FIG. 9, in a PDP having 3 electrodes arranged to drive discharge cells of 2 lines, the display electrodes Xa corresponding to discharge cells of odd-numbered lines and the display electrodes Xb corresponding to discharge cells of even-numbered lines are electrically connected in common at the front end of each line to then be collectively connected to a separate driving voltage source for practical use. By contrast, in order to enable line-sequential scanning, the display electrodes Y commonly corresponding to the discharge cells of odd- and even-numbered lines are independent line by line, and the rear end of each line L is connected to an individual driving voltage source corresponding to the line L. Here, as shown in FIG. 10, the pulse voltage for preventing an auxiliary discharge and the addressing pulse voltage are applied twice to the display electrodes Y so as to correspond to the driving pulse applied to the display electrodes Xa corresponding to the discharge cells of odd-numbered lines and driving pulse applied to the display electrode Xb corresponding to the discharge cells of even-numbered lines, respectively.

In each line, surface discharge cells are defined by the display electrodes Xa, Xb and Y for each unit emission region PU partitioned by the partitions 129 (see FIG. 8). Thus, selection (addressing) of a turned-on or turned-off state of each discharge cell is done by the display electrodes Y and the address electrodes A.

After addressing, a discharge sustaining process is performed for display a picture in the PDP. For the discharge sustaining process, wall charges are selectively accumulated by line-sequential scanning during the address period and then discharge sustaining pulses are alternately applied to the display electrodes Xa and Xb and the display electrode Y of all lines during the sustained discharge period.

Here, with respect to discharge cells of two neighboring lines, neighboring display electrodes Y are combined into one. Thus, since the display electrode Y is shared for every two lines, thereby narrowing the distance between electrodes, which implies that the widths of the display electrodes X and Y can be increased. If the widths of the display electrodes X and Y are increased, the areas of the display electrodes X and Y occupied in the unit emission region PU increase, thereby expanding the surface discharge and improving the luminance.

Furthermore, with respect to the display electrodes X having the same polarity and a common display electrode Y, if a driving voltage is applied by connecting a driving voltage source to the same-side ends (one end or both ends) in the direction in which these electrodes extend, the directions in which discharge current flows are the same as each other. Thus, despite a drop in the voltage due to resistance between the display electrodes X and Y, the potentials at various portions in the extending direction become substantially the same as each other between the lines L. In other words, even if there is a relatively large potential difference between the ends and central portion of the display electrodes X and Y, like in the case of a large screen in which the display electrodes X and Y are long, the potentials are substantially evenly distributed along a line direction in the display electrodes X (or Y) having the same polarity and there is no difference in the potential in a columnar direction.

Although a reflection-type PDP has been described in the illustrative embodiment, the present invention can also be applied to a transmission-type PDP in which phosphors 128 are disposed on the inner surface of the glass substrate 111 of a displayed surface (H) side. Also, the address electrodes A may be arranged on the glass substrate 112 where the display electrodes X and Y are arranged.

As described above, in the surface discharge type PDP driving method according to the present invention, non-discharge regions are removed by combining X-electrodes and Y-electrodes traversing neighboring discharge cells or Y-(scanning) electrodes traversing neighboring discharge cells are combined into one to be used in common.

Advantages of the above-described PDP when it is driven by a progressive driving method will now be described.

In the case of progressively driving the PDP in which non-discharge regions are removed by combining X-electrodes and Y-electrodes traversing neighboring discharge cells, the PDP has the following advantages.

First, the electrodes are arranged in the order of X-Y-X-Y-X-Y- . . . so that discharges occur between all discharge sustaining (display) electrodes, which can be displayed by a sequential scanning method, thereby reducing the number of discharge sustaining electrodes necessary under the specification of the same pixel block for all HD broadcasting formats. That is to say, an effect of increasing the resolution by about two times can be obtained for 720P and 1080P HD broadcasting formats. In other words, non-discharge regions which are unavoidably present in the conventional three-electrode surface discharge type PDP can be completely removed, which implies that discharge regions can expand corresponding to the removed non-discharge regions, thereby improving the luminance by about two times.

Second, with respect to the respective display electrodes X and Y, since two electrodes are reduced into one, the number of scanning electrodes is reduced to half that of the conventional PDP. Here, the common block of the X electrodes is increased to two. Thus, the reduced number of drivers equals (VP/2)−1, where the character VP refers to the number of vertical pixels of the display format. That is, since the required number of driving circuits is reduced corresponding to the reduced number of drivers, the cost can be reduced.

Next, in the case of progressively driving the PDP in which Y-electrodes traversing neighboring discharge cells are combined into one to be used in common, the PDP has the following advantages.

In the conventional PDP having the electrode structure arranged in the order of X-Y-Y-X-X-Y-Y-X-X-Y- . . . in which a discharge cell is formed by two electrodes, non-discharge regions are unavoidably present between the electrodes Y and Y. Thus, in order to overcome this problem, a projection type electrode structure is employed, and a pattern dielectric layer is formed on a bus electrode. Also, the driving frequency is increased. However, the non-discharge regions cannot be completely removed by the conventional PDP. However, according to the present invention, two electrodes Y-Y are reduced into one. Thus, the non-discharge region which have occurred between Y-Y electrodes, like in the conventional PDP electrode structure, can be removed. Although the respective discharge cells must be somewhat separated from each other for driving the same, by forming a patterned dielectric layer or partition on the Y electrode, the gap produced by separating the respective discharge cells is considerably smaller than that in the conventional case.

For example, in the case of the 50" PDP structure manufactured by Pioneer Electronic Corporation, the Y-Y electrode interval is 348 $\mu$m, inclusive of the width of a bus electrode, which is 43% of the length of a cell. In the electrode structure of the present invention, since the gap corresponding to the width of at least one bus electrode can be removed, the non-discharge region of about 100 $\mu$m (12% of the length of a cell) can be reduced. Also, assuming that the width of a partition of a line direction is set to 100 $\mu$m, the non-discharge region of about 248 $\mu$m (31% of the length of a cell) can be reduced. The reduced amount of the non-discharge region can be calculated in comparison with the case of the 50" PDP by Pioneer. Since the non-discharge region occurs only between Y-Y electrodes, ½ (0.5) must be multiplied for each discharge cell.

$(100/348)\times 0.5=14.4$(%/cell) (to the minimum)

$(248/348)\times 0.5=35.6$(%/cell) (to the maximum)

In conclusion, the non-discharge region can be reduced to 50% compared to the conventional case. Thus, since the discharge region corresponding to the reduced non-discharge region is increased, the luminance can be enhanced.

Second, since two electrodes are reduced into one, the number of scanning electrodes is reduced to half that of the conventional PDP. Here, the common block of the X electrodes is increased to two. Thus, the reduced number of drivers equals (VP/2)−1 where the character VP refers to the number of vertical pixels of the display format. That is, since the required number of driving circuits is reduced corresponding to the reduced number of drivers, the cost can be reduced.

As described above, the surface charge type PDP according to the present invention can reduce the number of driver circuits. Also, since the distance between electrodes of the respective lines can be reduced, a high- precision PDP can be achieved by reducing the line pitch. Also, the ratio of the area occupied by display electrodes in a unit emission region is increased and the range in which a surface discharge occurs is extended, thereby improving the luminance.

Further, the luminous efficacy can be enhanced by reducing the shielding by the display electrodes. Despite of a drop in the voltage due to resistance between the display electrodes, since there is no potential difference between lines at various portions of the line direction, a large-screen display can be easily achieved.

What is claimed is:

1. A method for driving an alternating-current (AC) type surface discharge plasma display panel (PDP) having two substrate to be opposed to each other, address electrodes arranged on the opposing surface of one of two substrates in a stripe pattern, and discharge sustaining electrodes on the opposing surface of the other substrate in a stripe pattern to intersect the data electrodes, wherein assuming that common electrodes of odd-numbered lines are denoted by Xa, common electrodes of even-numbered lines are denoted by Xb, and an nth B scanning electrode is denoted by Yn, where n=1, 2, 3, . . . , the common electrodes and the scanning electrodes are arranged in the order Xa-Y1-Xb-Y2-Xa-Y3-Xb-Y4- . . . so that discharge cells of 2n lines are formed by (2n+1) discharge sustaining electrodes, the method comprising the steps of:

in an addressing period in which an address pulse is applied to the addressing electrodes, sequentially applying to the Y electrodes a pulse for addressing, having the opposite polarity to that of the address pulse, in a period corresponding to the address pulse of the addressing electrodes, and a pulse for an auxiliary discharge, having the opposite polarity to that of the pulse for addressing, in a preceding period of the period corresponding to the address pulse of the addressing electrodes, the pulse for an auxiliary discharge and the pulse for addressing being applied twice for each Y electrode; and independently coupling Xa electrodes and Xb electrodes in pairs, and applying to the paired Xa and Xb electrodes pulses for preventing an auxiliary discharge having the same polarity in the same period as that of the pulse for an auxiliary discharge, the pulses for preventing an auxiliary discharge, corresponding to two pulses for an auxiliary discharge, which are applied to the same Y electrodes, being independently applied to the Xa electrodes and the Xb electrodes, respectively, and the pulses for preventing an auxiliary discharge, corresponding to the pulse for an auxiliary discharge applied second to the Y electrode which is driven previously among two neighboring Y electrodes and corresponding to the pulse for an auxiliary discharge applied first to the Y electrode which is driven later, being applied to the same X electrodes among the Xa electrodes and the Xb electrodes.

2. The method according to claim 1, wherein a striped partition for defining discharge cells is provided.

3. The method according to claim 1, wherein a matrix partition for defining discharge cells is provided.

4. The method according to claim 1, wherein the discharge sustaining electrodes are constructed such that an I- or T-shaped transparent conductive layer is basically disposed and striped bus electrodes are arranged thereon.

5. The method according to claim 1, wherein the discharge sustaining electrodes are constructed such that striped bus electrodes are basically arranged and an I- or T-shaped transparent conductive layer is disposed thereon.

6. A method for driving an alternating-current (AC) type surface discharge plasma display panel (PDP) having three electrodes provided for discharge cells of every two lines, to form discharge sustaining electrodes arranged such that two common electrodes (Xa) are disposed in either side and a scanning electrode (Yn where n=1, 2, 3, . . . ) is disposed in the center, wherein assuming that common electrodes of odd-numbered lines are denoted by Xa and the common electrodes of even-numbered lines are denoted by Xb, the overall common and scanning electrodes of the PDP are arranged in the order Xa-Y1-Xb-Xa-Y2-Xb-XaY3-Xb-Xa-Y4- . . . Xa-Yn-Xb to drive the discharge sustaining electrodes, the method comprising the steps of:

in an addressing period in which a pulse for addressing is applied to addressing electrodes of the PDP, applying to the Y electrodes a pulse for addressing in a period corresponding to the address pulse of the addressing electrodes, and a pulse for an auxiliary discharge, having a polarity opposite to that of the pulse for addressing, in a preceding period of the period corresponding to the address pulse of the addressing electrodes, the pulse for an auxiliary discharge and the pulse for addressing being sequentially applied twice for each electrode; and independently coupling Xa electrodes and Xb electrodes in pairs, and applying thereto pulses for preventing an auxiliary discharge having the same polarity in different periods, the pulses for preventing an auxiliary discharge being applied to the Xa electrodes in the period corresponding to the second pulse for an auxiliary discharge and the pulses for preventing an auxiliary discharge being applied to the Xb electrodes in the period corresponding to the first pulse for an auxiliary discharge.

* * * * *